United States Patent [19]

Nelson

[11] 4,182,598

[45] Jan. 8, 1980

[54] TURBINE BLADE DAMPER

[75] Inventor: Charles J. Nelson, West Palm Beach, Fla.

[73] Assignee: United Technologies Corporation, Hartford, Conn.

[21] Appl. No.: 828,457

[22] Filed: Aug. 29, 1977

[51] Int. Cl.[2] ..... F01D 5/10

[52] U.S. Cl. ..... 416/193 A; 416/500

[58] Field of Search ..... 416/193 A, 220, 221, 416/500

[56] References Cited

U.S. PATENT DOCUMENTS

| | | | |
|---|---|---|---|
| 3,112,915 | 12/1963 | Morris | 416/193 A X |
| 3,266,770 | 8/1966 | Harlow | 416/193 A X |
| 3,610,778 | 10/1971 | Suter | 416/221 X |
| 3,709,631 | 1/1973 | Karstensen et al. | 416/221 X |
| 3,751,183 | 8/1973 | Nichols et al. | 416/193 A X |
| 3,834,831 | 9/1974 | Mitchell | 416/193 A X |
| 3,936,222 | 2/1976 | Asplund et al. | 416/193 A X |

FOREIGN PATENT DOCUMENTS

| | | | |
|---|---|---|---|
| 1259750 | 1/1972 | United Kingdom | 416/193 A |

*Primary Examiner*—Everette A. Powell, Jr.
*Attorney, Agent, or Firm*—Jack N. McCarthy

[57] ABSTRACT

A vibration damper for use in a turbine rotor of a high temperature gas turbine is disclosed. The damper is loosely mounted in an opening formed between adjacent blade rails, the end of the rotor disk connector, and sections of adjacent blade necks between the rails and the disk connector. A cover plate positioned against one side of the turbine blade and a projection extending downwardly from the other side of the turbine blade confines the damper axially in the opening.

6 Claims, 4 Drawing Figures

FIG. 1
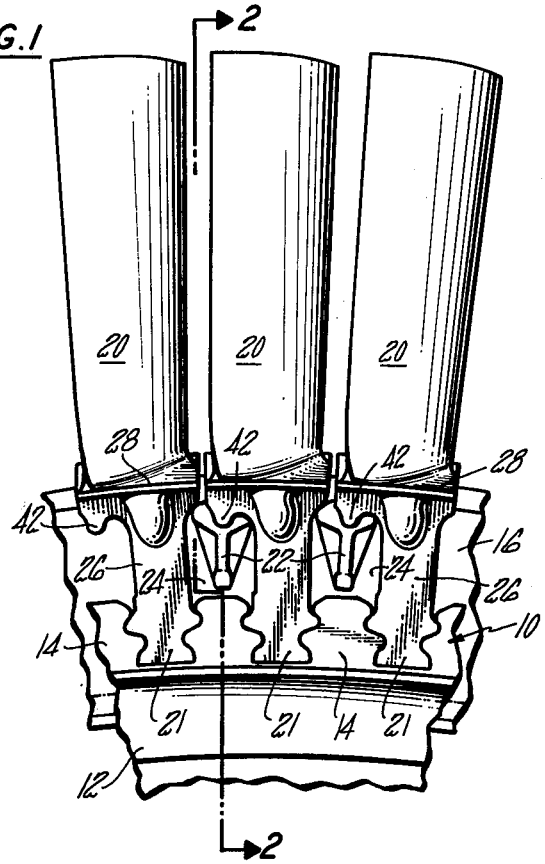
FIG. 2
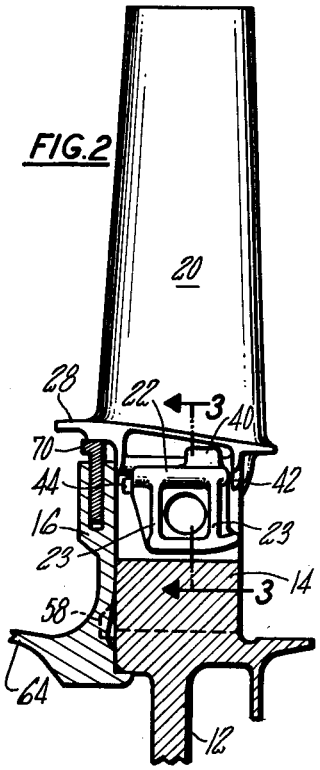
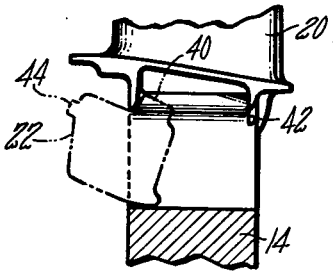
FIG. 4
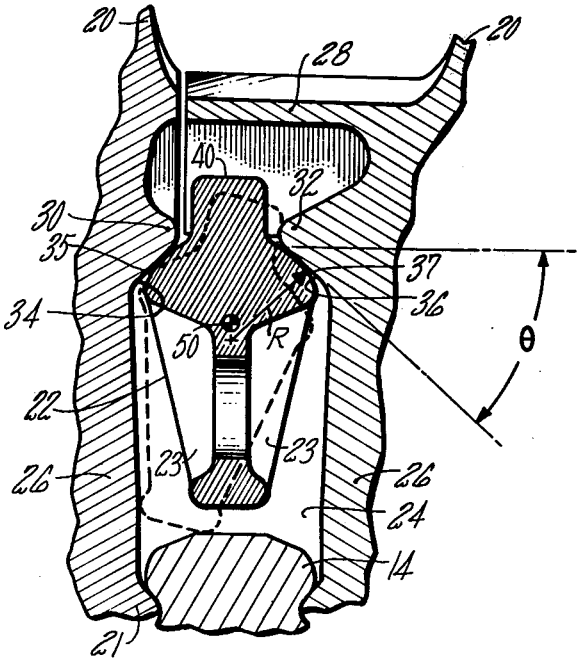
FIG. 3

TURBINE BLADE DAMPER

BACKGROUND OF THE INVENTION

1. Field of the Invention

This invention relates to gas turbine construction and more particularly to loosely mounted vibration dampers used with gas turbine blades exposed to high temperatures.

2. Description of the Prior Art

The construction of blades for rotating equipment such as gas turbine or compressor wheels has always required precise engineering to assure that the blades are properly secured to the wheel and that an intolerable amount of vibration does not appear in the blades during operation. Turbine blade design is generally more critical than compressor blade design since turbine blades are exposed to hot gases and experience high stress levels which result from centrifugal, aerodynamic and vibratory loadings on the blades.

Generally speaking, turbine blades tend to change dimension under load in three different directions; axially—along the axis of rotation of the turbine wheel, radially—in the plane of the turbine wheel and tangentially—in the plane of the turbine wheel rotation.

The axial growth presents a relatively small concern because the blades can, for example, be held tightly by side plates attached to the turbine wheel. As the wheel expands and contracts, the side plates and the turbine blades experience corresponding dimension changes and no axial loosening of the blades occurs. Further, there is an axial clearance between adjacent turbine wheels and the change in axial dimension of a given wheel due to thermal growth does not result in any physical interference between adjacent turbine wheels.

Similarly, the radial growth presents a relatively small problem. Turbine blades are often attached to turbine wheels by the familiar fir tree attachment means wherein the contour of the root of the blade conforms closely to the contour of the mating surfaces in the wheel. As the wheel is rotated, centrifugal loading on the blade causes the blade root to maintain a positive contact a bearing surfaces common to the blade and the wheel.

The tangential growth is more difficult to accommodate. Unless an appropriate room temperature clearance is left between the platforms of adjacent turbine blades, the blades will be physically restrained from expanding in the tangential direction when they are heated sufficiently. Jamming or mechanical interlocking of the platforms of adjacent turbine blades and the consequential high stress levels can be eliminated by providing tangential clearance between adjacent blades; however, the blades then tend to vibrate during operation.

Tangential vibrations are sometimes controlled by constructing tip shrouds on the blades. The shrouds connect the tip sections of the adjacent blades and tend to damp and make more consistent the tangential vibrations which occur in the blades. As the gas turbine engine performance has improved, the temperature to which the turbine blades are exposed has increased and the shroud concept has become less attractive because cracks occur in the shroud section of the blade and propagate downward through the blade, resulting in premature failure of the blade. Further, turbine blade shrouding is conceptually undesirable because the diameter of the section of the engine where the shrouding is required tends to increase; also, the shrouding results in a high concentration of mass at a location which is relatively distant from the centerline of rotation, resulting in structural limitations in the engine. Therefore, a trend towards shroudless turbine blades exists. Since the shroudless blade is particularly susceptible to tangential vibration in the airfoil section of the blade, various devices have been resorted to in an attempt to minimize such vibrations. One of the accepted vibration damping schemes is a toggle device. A toggle is a nonstructural member which is held in physical contact with a turbine blade by centrifugal force during rotation of the turbine engine. The toggle reduces the vibratory action of the blade by imposing a retarding force due to friction on the blade at the point of contact between the toggle and the blade. When turbine blades are damped by toggles, each blade tends to vibrate at a frequency which is independent of that in the adjacent blades and the resulting stress levels in some blades becomes high with respect to that in other blades in the same wheel. Also, toggles impose relatively high centrifugal loads on their retaining structure. Further, space limitations impose restrictions on the mass of a toggle which in turn limits the damping force imposed on the blades. Therefore, engine manufacturers are continually searching for alternate inexpensive vibration dampers for use in high temperature, gas turbine applications.

A similar turbine blade damper is shown in U.S. Pat. No. 3,666,376 having an X-shaped construction.

SUMMARY OF THE INVENTION

An object of this invention is to dampen the vibrations in a turbine blade by placing a loosely mounted damper between blade extending necks for bearing on rails extending from adjacent blades for providing a force radially outward from the damper which in turn provides a frictional force opposing the deflections of the vibrating blade in both axial and tangential directions. The rubbing between the contacting surfaces absorbs energy of the vibrating blades and thereby controls the stress level in the blade.

A further object of the invention is to provide contact between the damper and blade regardless of the position of the damper. This is done by using a radius on the surface of the damper to mate with a flat surface on an adjacent blade rail. The center of the radius of the damper contacting surface is located very close to the center of gravity (c.g.) of the damper to prevent shifting of the contacting points.

Another object of the invention is to provide an upwardly extending tang on the damper so that the damper will remain substantially centered and not contact the side of the neck of a blade at any other point during operation.

It is a further object of this invention to provide a damper which is configured to prevent possible misassembly and the blade and disk opening must be able to receive the damper with the blade roots installed in the holding openings in the disk.

It is a further object of this invention to provide a damping construction when additional damping normal forces may be generated by increasing the angle of the blade damping surface within limits thereby reducing the total deadload required to be restrained by the turbine disk.

BRIEF DESCRIPTION OF THE DRAWINGS

FIG. 1 is a view of a portion of a turbine rotor showing the damper mounted in its operating position, positioned outwardly against the blade rails by centrifugal force;

FIG. 2 is a view taken along the lines 2—2 of FIG. 1;

FIG. 3 is a view taken along the line 3—3 of FIG. 2; and

FIG. 4 is a fragmentary view showing how the damper is placed in its opening with the blade roots positioned between the connectors on the turbine disk.

DESCRIPTION OF THE PREFERRED EMBODIMENT

A portion of a turbine rotor assembly 10 is shown in FIG. 1. A turbine disk 12 having fir-tree type connectors 14 on the periphery has turbine blades 20 connected thereto by root sections 21 with a fir-tree configuration. The blades have an extended neck section 26 between the blade platforms 28 and root sections 21. A loosely mounted damper 22 is placed in an opening 24 which is formed between adjacent blades 20 and the top of the rotor disk connectors 14.

A view through the blade attachment shows the damper located in its operating position. Blade rails 30 and 32 extend axially along the top of the neck section 26 of the blade 20 below the platform 28. Blade rails 30 and 32 present downwardly facing angular blade surfaces 34 and 36, respectively.

The damper 22 is formed substantially T-shaped with strengthening ribs 23 on each side thereof. Each side of the top of the T is formed having a curved surface 35 and 37 with a radius R being taken from a center adjacent the center of gravity 50 of the damper 22.

A projection 40 extends from the upper surface of the center of the top of the T-shape to positively prevent the damper from sliding out of the rear of the opening 24 and to prevent the bottom of the damper 22 from touching the sides of the neck portions 26 when the engine is in operation. It can be seen from FIG. 3 that the side of the projection 40 will hit a tip of a blade rail 30 or 32 before the bottom of the damper 22 will touch a neck portion 26 if the damper is moved about the center of R. A downwardly projecting narrow flange 42 extends downwardly from the platform 28 at the top of the center of opening 24 so as to positively contact the projection 40 on the damper 22 to insure retention thereof. The damper 22 is constructed so that the projection 40 will fit under a normal flange on the forward side so that the damper 22 can be installed after the blades 20 have been installed in the rotor disk 12 (see FIG. 4). A short projection 44 extends from the forward end of the damper 22 to limit its axial movement between the projecting flange 42 and a cover plate 16 which is fixed against the forward portion of the rotor assembly 10 covering the blade roots and upper part of the turbine disk 12. This cover plate may be fixed in position by many known means. One means is shown in U.S. Pat. No. 3,990,807. However, the plate may be bolted thereto. U.S. Pat. No. 3,666,376 uses a front cover plate 16 bolted through to a rear cover plate. Only one cover plate is needed in this construction since a tang 58, integral with the blade root, contacts the front of the rotor disk 12 to retain the blade roots of all the blades from sliding out the rear of the rotor disk. Openings are provided in the cover plate 16 to accommodate the tangs 58. A cylindrical member 64 can extend to another rotor disk.

In operation, the damper 22 is forced outwardly in its opening 24 so that the projection 40 extends between the rails 30 and 32 and the surface 35 on one side of the damper contacts the surface 34 of one blade while the surface 37 of the other side of the damper 22 contacts the surface 36 on the adjacent blade. The contact between the surfaces absorbs energy of the vibrating blades and thereby controls the stress level in the blade. As stated hereinbefore, the center of the radius of the damper contacting surfaces 35 and 37 is located very close to the center of gravity so that the contacting points on the blade will not shift. For a given mass of the damper 22 additional damping normal forces may be generated by increasing the damper angle between the centerline of the blade 20 and the surface 36.

It is noted that this damper 22 can be used alone or in conjunction with other types of dampers. In FIG. 2, a representation of a toggle damper 70 is shown.

I claim:

1. A turbine rotor comprising a turbine disk with turbine blade connector means; turbine blades with each blade attached to the turbine disk and having an airfoil, a platform, an extended neck section, and a root section, said platform being intermediate of the airfoil and the extended neck section, an axially extending blade rail located below the platform at the top of the extended neck section on each side thereof; means for fixing said turbine blades in said turbine disk; dampers, with each damper fitting into an opening formed by the adjacent extending neck sections of each pair of adjacent blades, the adjacent blade rails of adjacent blades and the turbine disk, said blade rails having axially extending downwardly facing flat surfaces at an angle to the centerline of each blade while the tops of the dampers have a curved surface on each side for contacting the surfaces of the blade rails during rotation of the rotor due to centrifugal loading on the dampers, a space is located between the adjacent ends of adjacent blade rails, each damper having a projection extending upwardly therefrom for extending between said blade rails, said projection being of such a width that during rotation of the rotor the bottom of the damper will be prevented from touching either of the adjacent extending neck sections of adjacent blades.

2. A combination as set forth in claim 1 wherein said axially extending blade rails extend for the full axial length of the extended neck section so that said curved surface on each side of a damper will always have line contact along its entire length with its cooperating blade rail.

3. A combination as set forth in claim 1 wherein said means for fixing said turbine blades in said turbine disk includes a cover plate on the forward side of said disk, an extension on the forward end of said damper to control the axial movement of the damper in its opening.

4. A combination as set forth in claim 1 wherein each of said blades has a downwardly extending narrow projection to coact with said upwardly extending damper projection to insure that said damper cannot be removed from the rear of the turbine disk and blades.

5. A combination as set forth in claim 1 wherein the radius of curvature of the curved surface on each side of the top of the damper is formed of a radius R which has its center located adjacent the center of gravity of said damper.

6. A combination as set forth in claim 1 wherein said projection is of such a length that the damper cannot be removed from the rear end of the turbine disk and turbine blades.

* * * * *